United States Patent [19]

Swiderski

[11] 4,157,112

[45] Jun. 5, 1979

[54] AIR CONDITIONING METHOD

[75] Inventor: Kazimierz Swiderski, Don Mills, Canada

[73] Assignee: Canada Square Management Ltd., Toronto, Canada

[21] Appl. No.: 879,546

[22] Filed: Feb. 21, 1978

[30] Foreign Application Priority Data

Mar. 17, 1977 [CA] Canada ..... 274221

[51] Int. Cl.[2] ..... F25B 13/00

[52] U.S. Cl. ..... 165/2; 62/97; 165/16; 165/50

[58] Field of Search ..... 165/2, 3, 16, 50, 59; 62/97, 427; 98/33 R

[56] References Cited

U.S. PATENT DOCUMENTS 3,945,432 3/1976 Tamblyn ..... 165/50 X

FOREIGN PATENT DOCUMENTS 1037684 8/1958 Fed. Rep. of Germany ..... 165/59

*Primary Examiner*—Samuel Scott
*Assistant Examiner*—Margaret A. Focarino
*Attorney, Agent, or Firm*—Rogers, Bereskin & Parr

[57] ABSTRACT

The disclosure relates to a method of air conditioning a multi-storey building having a core area and a plurality of occupied spaces disposed around said core area and arranged in zones. The method includes the steps of recirculating air in each said zone from the occupied spaces in said zone to a common fan compartment and back to said spaces through individual ducts, while maintaining the air entering said ducts at a temperature at least substantially as high as the temperature of the air returned to the fan compartment from said spaces. The air flowing through each duct is individually cooled in the event that the temperature of the air in the associated space is above the required temperature. Conditioned fresh air is delivered to the core area of the building for cooling said area and make-up air is delivered to the individual zones of the building from said conditioned fresh air as required. An air conditioning system is also disclosed.

9 Claims, 3 Drawing Figures

AIR CONDITIONING METHOD

BACKGROUND

This invention relates to air conditioning systems for multi-storey buildings.

In buildings of this kind, working and/or living spaces (hereinafter called "occupied spaces") are usually located in peripheral areas of the building around a central core area which houses elevators and other service facilities. The core area normally represents a fairly constant cooling load in the building; that is, it requires year round cooling. The occupied spaces on the other hand have varying heating and cooling requirements depending on such factors as ambient temperature, heat gain from solar radiation, lighting and other sources within the building, and the preferences of individual occupants of the spaces. In multi-storey buildings in North America, the sources of heat gain are normally such that cooling is the predominant requirement in the peripheral occupied spaces.

In view of these considerations, conventional air conditioning systems have been designed primarily for cooling and have included means for so-called "terminal reheating" of air in the occupied spaces of the building as required. Early systems relied on a single fan arrangement for delivering substantial volumes of cooled air both to the core and to the peripheral spaces of the building. In more modern systems, each floor of the building has an individual fan room provided with a chiller from which cooled air is delivered to the individual occupied spaces on that floor and the spaces have individual air re-heating devices. A separate fan system delivers cooled fresh air to the core of the building.

All of these systems operate on the principle of cooling the whole building and locally re-heating specific areas according to requirements. Accordingly, these systems are wasteful of energy and expensive to operate. Energy is required to cool the air delivered to the occupied spaces and core area of the building, and further energy must be expended to re-heat that previously cooled air in the occupied spaces when required.

SUMMARY

An object of the present invention is to provide an improved method of air conditioning a multi-storey building having a core area and a plurality of occupied spaces disposed around said core area and arranged in zones. The method includes the step of recirculating air in each said zone from the occupied spaces in said zone to a common fan compartment and back to said spaces through individual ducts, while maintaining the air entering said ducts at a temperature at least substantially as high as the temperature of the air returned to the fan compartment from said spaces. The air flowing through each duct is individually cooled in the event that the temperature of the air in the associated space is above the required temperature. Conditioned fresh air is delivered to the core area of the building for cooling said area and make-up air is delivered to the individual zones of the building from said conditioned fresh air as required.

The invention also provides a system for air conditioning a multi-storey building in accordance with said method.

In order that the invention may be more clearly understood, reference will now be made to the accompanying drawings which diagrammatically illustrate a preferred embodiment of the invention, and in which.

Figure 1:
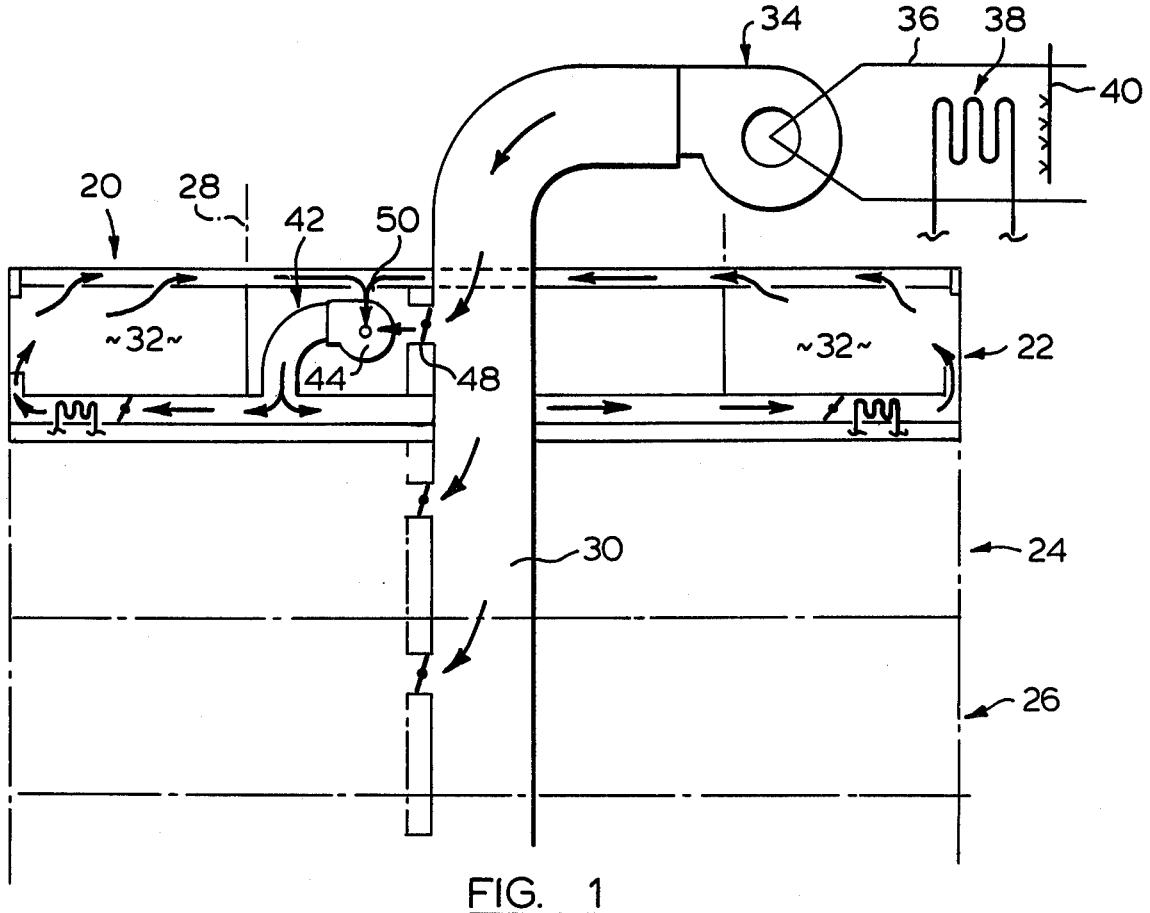
FIG. 1 is a vertical sectional view through a multi-storey building which is air conditioned in accordance with the method of the invention.
Figure 3:
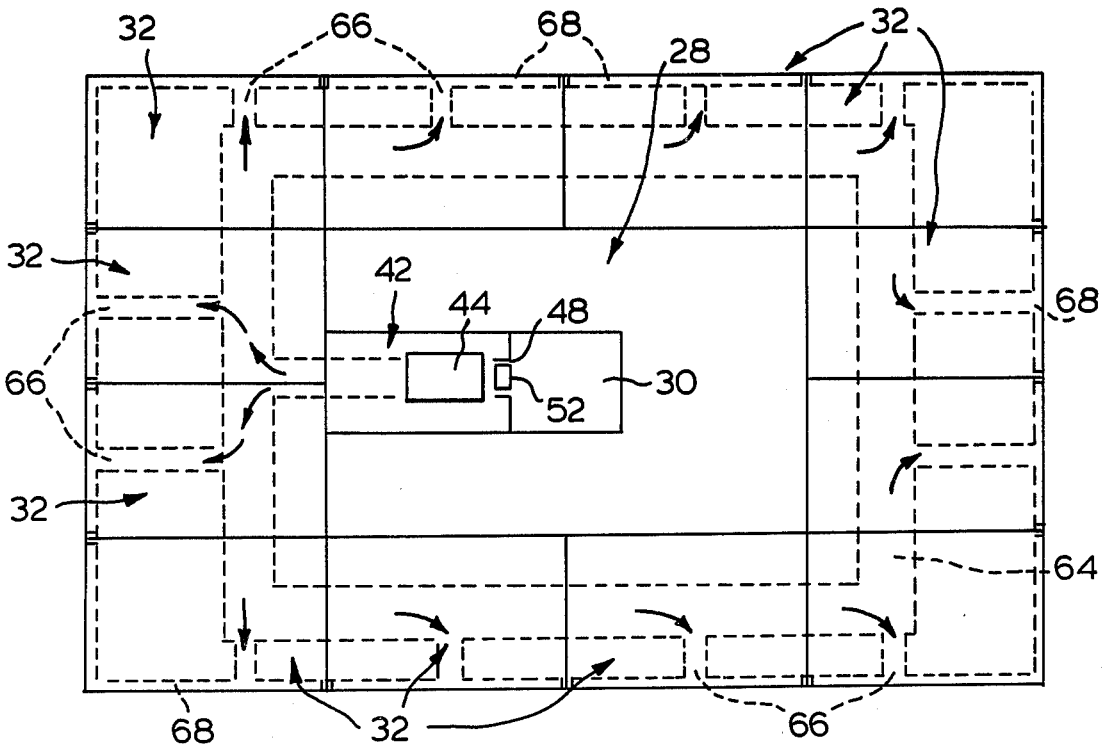
FIG. 3 is a floor plan of one of the storeys of the building of FIG. 1.

Referring first to FIG. 1, a multi-storey building is generally indicated at 20 and includes three upper floors denoted 22, 24 and 26. Each floor in the building has an individual air circulation system such as that shown for floor 22; the systems for the other floors have not been shown since they are essentially similar. FIG. 3 is a plan of floor 22 and again is to be considered as representative of all of the floors of the building.

The building includes a core area which can best be seen in FIG. 3 and which is denoted 28. Area 28 includes a fresh air supply duct 30 (see also FIG. 1) which extends vertically through the building and which communicates with each floor as will be described. The core area also includes elevators (not shown) and other service facilities as is normal in modern multi-storey buildings. A plurality of occupied spaces denoted 32 are disposed around the core area 28 and represent working and/or living spaces at the periphery of the building. In this connection, it is to be noted that FIG. 3 is a diagrammatic illustration only and is not intended to represent an actual floor plan. For example, doors providing access to the occupied spaces and interconnecting passageways have not been shown; also, in an actual building, the individual occupied spaces would probably not all be of the same size. In any event, the occupied spaces 32 on each floor of the building are connected in a common air circulation circuit for that floor, which circuit forms part of the overall air conditioning system of the building.

Referring back to FIG. 1, the fresh air supply duct 30 extends vertically through the building and communicates at its upper end with a fan 34 which draws fresh air into the building through an inlet 36 and delivers it into the duct 30. Fan 34 and inlet 36 form part of an air conditioning unit mounted on the roof of the building. Inlet 36 is fitted with water coils 38 which can be used to preheat or precool the incoming air (depending on the ambient temperature and the requirements of the building), and water spray heads 40 for controlling the humidity of the air. Accordingly, fan 34 delivers conditioned fresh air into the duct 30. This air flows down through the core area of the building and cools that area. The air in duct 30 also serves as a source of make-up air for the individual floors of the building as will be described.

The air in the occupied spaces on each floor is recirculated between the spaces and a fan compartment located on the floor adjacent to the fresh air duct 30. Referring specifically to the top floor 22 of the building, the fan compartment for that floor is indicated at 42 and houses an air circulation fan 44. Fan 44 has an inlet 46 which communicates with the interior of the fan compartment and the compartment in turn has two inlets 48 and 50. Inlet 48 communicates with the fresh air supply duct 30 and is controlled by a damper 52 which can be adjusted to allow fresh, conditioned make-up air to be drawn into the fan compartment 42 as required. Inlet 50 communicates with a return air duct 54 which is disposed above the ceilings 56 of the occupied spaces 32 and into which air is drawn by fan 44 through openings 58 in the ceilings.

Fan 44 delivers into an outlet duct 60 which communicates with an air duct system below the floor surface 62 of the occupied spaces 32. The air duct system includes individual ducts communicating with the occupied spaces 32 as will now be described with particular reference to FIG. 3. In that view, fan 44 is indicated purely diagrammatically and the air duct system into which it discharges is shown in dotted outline. The fan outlet duct 60 delivers air into an endless duct section or "ring" duct 64 which encircles the core area 28 of the floor and runs below each of the occupied spaces on floor 22. Individual "branch" ducts 66 extend outwardly from duct section 64 below each occupied space 32. Each duct includes at its outer end a window outlet or register 68 at the periphery of the building. One of the individual ducts 66 is visible in FIG. 2. It will be seen that the register 68 has outlet openings 70 disposed adjacent the inner surface of a double glazed window panel 72 for that occupied space. Accordingly, air delivered by the fan 44 flows to the occupied space 32 along its individual duct 66, and out into the space through the openings 70 in the associated register 68. The air then returns to the fan compartment 42 by way of the ceiling ducts 54. The air is thus continuously recirculated by fan 44.

Each of the individual air supply ducts 66 is fitted with a water cooling coil 74 disposed immediately upstream of the outlet openings 70. Upstream of the cooling coil 74 is a damper or throttle 76 which is adjustable to vary the volume of air flowing through duct 66. In an alternative embodiment, the coil 74 and throttle 76 could in fact be incorporated in the register 68. Throttle 76 is provided with a manual adjustor 78 which is accessible from within the occupied space 32 and by which the position of the throttle and hence the volume of air flowing through duct 66 can be adjusted. Cooling coil 74 has an associated valve 80 having a manual adjustor 82 which is also accessible from within the occupied space 32. Valve 80 can be controlled by adjustor 82 to vary the volume of water flowing through coil 74. It will be appreciated from the foregoing that the volume of air flowing in each of the ducts 66 can be individually controlled from within the associated occupied space and that the cooling effect of each coil 74 can similarly be adjusted from within the associated occupied space. The cooling coils 74 throughout the building are connected to a common refrigeration unit (not shown) set to product a supply of cold water at a temperature appropriate to the cooling capacity required.

In use, air is recirculated on each floor of the building, from the occupied spaces on said floor, to the common fan compartment 42 and back to the spaces through the individual ducts 66. The air entering the ducts will be at a temperature at least substantially as high as the temperature of the air entering the fan compartment from the overhead ducts 54. It is believed that the sources of heat in the occupied spaces 32 (including heat derived from solar energy, from the occupants of the spaces, from lights and office equipment) will be sufficient to warm the air passing through the spaces to a temperature at or above the temperature required in the spaces, at least for a substantial part of the year (in a building located in North America). Obviously, the extent to which these naturally available sources of heat affect the air temperature will depend on considerations such as the orientation of the building and the climate. Expedients such as solar energy collector panels may be employed in the building to increase solar heat gain in the occupied spaces. However, in order to provide a standby heating facility for extra-ordinary climatic conditions, or in buildings located in extremely cold climates, a heating coil such as that indicated at 84 may be provided in association with each fan 44 so that the air entering the individual ducts 66 can, if necessary, be heated to a temperature above that at which it is returned from the occupied spaces. These heating coils would be connected in a common heating circuit of the building (not shown) and would be supplied from a conventional hot water boiler. Suitable valving arrangements (not shown) would of course be provided for controlling the amount of heat supplied by the coils. The individual cooling coils 74 could of course be used to compensate for the effect of heating coil 84 in those of the occupied spaces in which heating is not required.

Fan 44 also incorporates conventional air filtering and cleaning equipment (not shown) for treating the air delivered to the occupied spaces.

Figure 2:
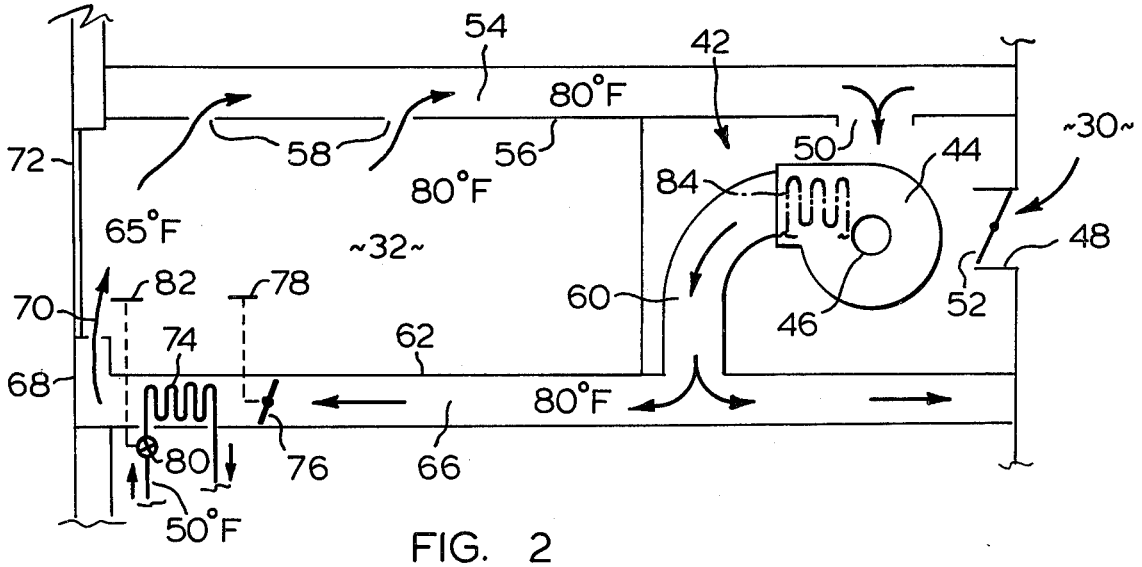
FIG. 2 is an enlarged view of part of FIG. 1.

By way of example, typical air temperature levels have been indicated in FIG. 2 at various parts of the air circulation system. Air at 80° F. enters the fan 44 from the overhead ducts 54 and is delivered substantially at this temperature into the individual underfloor ducts 66. In each duct, the air passes over the associated cooling coils 74 through which 50° F. water is circulated. This reduces the air temperature to 65° F. and results in an air temperature of 80° F. in the occupied spaces 32. It will be appreciated that, in this example, the sources of heat in the occupied spaces are such that the air temperature in the spaces would be increased to substantially above 80° F. in the absence of the cooling effect of coil 74. Typically, the temperature of the air entering the duct 66 would probably vary in the range 75° to 100° F. while the air entering the occupied spaces would be at a temperature of between 55° and 100° F.

Optimum efficiency of heat transfer between the air in each duct 66 and the associated cooling coil 74 is achieved when a minimum volume of air flows along the duct, allowing the air to remain in contact with the cooling coil for a maximum length of time. Accordingly, each coil 74 and the associated throttle 76 are preferably operated as follows. Starting from a situation in which no cooling is required, coil 74 is off and throttle 76 fully open. As the cooling load increases, throttle 76 is progressively closed to a position in which a minimum volume of air is recirculated to the occupied space. Assuming the cooling coil is off but is at a lower temperature than the air, the coil will have a cooling effect on the air. If further cooling is required, the cooling coil 74 is brought into operation in a condition in which a minimum volume of cooling water is flowing therethrough. The volume of water is progressively increased to a maximum at which a maximum cooling effect is achieved. In a sophisticated form of the described system, the cooling coil and throttle may be automatically controlled according to the temperature in the associated occupied space.

The air conditioning method provided by the invention has the advantage of minimizing energy comsumption. The method takes advantage of existing sources of heat to warm the air in the occupied spaces of the building and provides only localized cooling where required.

It will of course be appreciated that the preceding description relates to a specific embodiment which has been described by way of illustration only. Many modifications are possible within the broad scope of the invention. For example, while the invention has been described in connection with an air circulation system in which air is delivered to the occupied spaces through underfloor ducts and is returned to the fan compartment through overhead ducts, the air flow could be reversed. Alternatively, both sets of ducts could be arranged in overhead or underfloor positions.

The cooling coils for the air flowing in ducts 66 could be arranged in the ducts as shown in the drawings. However, from a practical point of view, the cooling coils would normally be disposed in the air registers adjacent the windows of the building.

Also it is to be noted that, while the description relates to a building in which the occupied spaces on each floor are air conditioned from a common fan compartment on that floor, this is not essential. In an alternative embodiment, occupied spaces on different floors of the building could be coupled with a common fan compartment. A "zone" as used in this application denotes any group of occupied spaces in a building which are coupled in a common air circulation circuit.

What I claim is:

1. A method of air conditioning a multi-storey building having a core area, and a plurality of occupied spaces disposed around said core area and arranged in zones, the method comprising the steps of:

recirculating air in each said zone of the building from the occupied spaces in said zone to a common fan compartment and back to said spaces through individual ducts, while maintaining the air entering said ducts at a temperature at least substantially as high as the temperature of the air returned to the fan compartment from said spaces;

individually cooling the air in each duct in the event that the temperature of the air in the associated space is above the required temperature;

delivering conditioned fresh air to the core area of the building; and, delivering make-up air from said conditioned fresh air to the occupied spaces of said individual zones of the building as required.

2. A method as claimed in claim 1, wherein said step of individually cooling the air flowing through each duct is performed by passing the air in each said duct over a cooling coil.

3. A method as claimed in claim 2, wherein the step of cooling the air additionally comprises controlling the volume of air flowing through each duct so as to optimize heat transfer efficiency between the cooling coil and the air in the duct.

4. A method as claimed in claim 1, wherein said conditioned fresh air is delivered to a duct extending vertically through the core area of the building, wherein the fan compartments of the individual zones of the building are disposed adjacent said duct, and wherein make-up air is delivered to the occupied spaces by providing outlets from said vertical ducts to said fan compartments, and controlling communication between the air in said fresh air duct and said fan compartments.

5. A method as claimed in claim 1, further comprising the additional step of heating the air in the appropriate one of said fan compartments in the event that the temperature of the air in an associated occupied space is below the required temperature.

6. A multi-storey building having a core area, a plurality of occupied spaces disposed around said core area and arranged in zones, and an air conditioning system, wherein the system comprises:

a common fan compartment for each said zone;

individual air delivery ducts communicating between said common fan compartment and the occupied spaces in each zone;

means for recirculating air in each said zone from the occupied spaces in the zone to said common fan compartment and back to the spaces through said individual ducts, while maintaining the air entering the ducts at a temperature at least as high as the temperature of the air returned to the fan compartment from the spaces;

means for individually cooling the air flowing through each said duct in the event that the temperature of the air in the associated space is above the required temperature;

a conditioned fresh air inlet duct extending vertically through the core area of the building;

means for delivering conditioned fresh air to said duct;

individual outlets from said duct communicating with each of said fan compartments of the system; and, means for controlling the air flowing through each said duct into the associated fan compartment in accordance with the make-up air requirements in the occupied spaces of the associated zone.

7. The invention claimed in claim 6, wherein said cooling means comprises a cooling coil disposed in each said duct of the air conditioning system.

8. The invention claimed in claim 7, further comprising adjustable throttle means disposed in each said duct of the air conditioning system for controlling the volume of air flowing past the cooling coil.

9. The invention claimed in claim 6, further comprising heating means disposed in each said fan compartment and operable to heat air delivered from said compartment to the associated occupied spaces in the building.

* * * * *